United States Patent [19]

Yokota et al.

[11] 4,138,275

[45] Feb. 6, 1979

[54] METHOD OF MANUFACTURING ALUMINUM ALLOY FOR ELECTRIC CONDUCTOR

[75] Inventors: Minoru Yokota, Nishinomiya; Kenichi Sato, Ibaraki, both of Japan

[73] Assignee: Sumitomo Electric Industries, Ltd., Osaka, Japan

[21] Appl. No.: 822,441

[22] Filed: Aug. 8, 1977

[30] Foreign Application Priority Data

| | | | |
|---|---|---|---|
| Aug. 10, 1976 | [JP] | Japan | 51-95578 |
| Aug. 10, 1976 | [JP] | Japan | 51-95579 |
| Aug. 10, 1976 | [JP] | Japan | 51-95580 |
| Aug. 10, 1976 | [JP] | Japan | 51-95581 |

[51] Int. Cl.[2] ..... C22F 1/04

[52] U.S. Cl. ..... 148/2; 75/138; 148/11.5 A; 148/32

[58] Field of Search ..... 148/2, 11.5 A, 32; 75/138

[56] References Cited

U.S. PATENT DOCUMENTS 3,827,917 8/1974 Zeigler et al. ..... 148/2

*Primary Examiner*—R. Dean

*Attorney, Agent, or Firm*—Carothers and Carothers

[57] ABSTRACT

A method of manufacturing an aluminum alloy for electric conductors wherein an aluminum alloy wire which possesses good elongation characteristics, high electric conductivity and high strength, after it has been worked to its final size, is obtained by casting an aluminum-iron alloy, which consists of 1.0 ~ 2.0% iron and a remainder substantially of aluminum, into an ingot and heating it at 500° 14 630° C. for 0.5 – 48 hours before or after said ingot is hot-worked into a wire rod.

8 Claims, No Drawings

METHOD OF MANUFACTURING ALUMINUM ALLOY FOR ELECTRIC CONDUCTOR

BACKGROUND OF THE INVENTION

The present invention relates to an aluminum alloy for electrical conductors which is easy to manufacture and which has good elongation characteristics.

In the past, soft copper wires were exclusively used for communication cable conductors, magnet wires, etc. However, aluminum has come to be used in partial substitution for them because of the exhaustion of copper resources and price fluctuations. For such aluminum, there is available aluminum of electric conductor grade (hereinafter to be referred to briefly as EC-Al), which has been in use for overhead transmission and distribution cables for some time. If this EC-Al is subjected to drawing work, it undergoes work hardening and its elongation decreases remarkably. With a cold working of about 90%, resulting in an elongation of 3% or less, its workability is also degraded remarkably. Furthermore, when it is used as a soft material, the EC-Al has at most a tensile strength of only 8–10 $Kg/mm^2$ and has had a drawback in that its mechanical strength is low.

With respect to Al-Fe alloys relating to the present invention, there is, for example, the alloy disclosed in U.S. Pat. No. 3,827,917. According to that patent, heating is done at 500° F. ~ 900° F. (260°~428° C.) in the intermediate process step after casting and working. This heating is done for the purpose of recovering electric conductivity by precipitating Fe in solid solution in the form of fine particles.

The present inventors have discovered there is a shortcoming in that although Fe in solid solution is precipitated in the form of fine particles and electric conductivity is recovered as mentioned in U.S. Pat. No. 3,827,919, if the temperature of the aforementioned heating in ingot form is as low as 499° C. or lower, the elongation characteristics of the alloy in a highly worked-on condition in the cold working step, done after the hot working, are degraded just as in the case of EC-Al, resulting in poor workability.

SUMMARY OF THE INVENTION

With a view to solving the aforementioned shortcoming, the present inventors made studies of a mumber of alloy types and as a result have discovered that tensile strength and elongation characteristics can be improved without much impairment of electric conductivity, as compared with EC-Al, by imparting a special working and heat treatment to Al-Fe type alloys within a suitable range of composition.

An object of the present invention is to provide a method of manufacturing an aluminum alloy for electric conductors which has good workability, is easy to manufacture and retains an excellent ductility in a highly worked-on condition, and which at the same time has a high electric conductivity and high strength as a soft material.

Another object of the present invention is to provide a method of manufacturing an aluminum alloy for conductors which is excellent in overall properties of ductility, conductivity and strength for communication cable conductors, magnet wires, housing wires, etc.

Still another object of the present invention is to provide a method of manufacturing an aluminum alloy for electric conductors which does not necessitate the use of troublesome skin pass work and continuous annealing in manufacturing conductors of a semi-hard or soft material for the aforementioned uses and which makes it possible to obtain desired properties only by heating at a high temperature in the ingot form or by batch heating after hot working.

The present invention comprises a method of manufacturing an aluminum alloy for electric conductors which is characterized in that an aluminum-iron type alloy consisting of 1.0–2.0% iron and the remainder substantially of aluminum, is cast into an ingot and is heated at 500° ~ 630° C. for 0.5 ~ 48 hours before or after said ingot is hot-worked into a wire rod.

For the aluminum-iron type alloy used in the method of the present invention, an alloy which contains 1.0–2.0% iron as an indispensable constituent and one element selected from the group consisting of 0.005 ~ 0.5% calcium, 0.001 ~ 0.2% bismuth and 0.01 ~ 0.5% antimony and the remainder substantially of aluminum, may also be used.

DETAILED DESCRIPTION OF THE INVENTION

According to the teachings of the present invention, an ingot of Al-Fe type alloy containing 1.0 ~ 2.0% iron is heated at 500° C. ~ 630° C. before it is hot-worked. Accordingly, precipitates as cast are coarsened to a size of 2μ ~ 8μ and Fe in solid solution is also precipitated as precipitates having a size of 0.5μ or more, so that a distribution of these large particles of $Al_3Fe$ may be obtained. By subjecting the alloy to working of 90% or more during the step of cold working that follows hot working, a conductor can be obtained which has excellent elongation characteristics of 4% or more in a highly worked-on condition. In this case, the electric conductivity of the wire rod can be 60% IACS or more.

If the conductor that has been subjected to cold-working of 90% or more is annealed within a temperature range of 150° ~ 600° C. for 0.5 Second — 10 hours, a conductor can be obtained which has excellent mechanical properties, with a tensile strength of 12 $Kg/mm^2$ or more, an elongation of 20% or more, and an electric conductivity of 61% IACS or more.

In the method of the present invention, the ingot of Al-Fe type alloy is ordinarily cast by the so-called Direct Chill casting process (hereinafter to be referred to as DC casting). As will be explained hereinafter in detail, where heating is done after hot-working in carrying out the method of the present invention, the casting and hot-rolling may be done by such a continuous casting and rolling process as the Properzi process.

The reason why the Fe-content is defined to be 1.0 ~ 2.0% in the present invention is that if the content is less than 1.0%, the elongation characteristics cannot be improved no matter what working method may be selected; while if the content is in excess of 2.0%, a remarkable degradation of resistance to corrosion is observed.

Ca, Bi or Sb is an element that is added for the purpose of improving elongation characteristics and cold-workability in the cold-working condition.

The reason why the Ca-content is defined to be 0.005 ~ 0.5% is that if the Ca-content is less than 0.005%, there is no effect on Al-Fe alloys for improvement of elongation characteristics, but if it is in excess of 0.5%, not only does the intended effect for improving elongation characteristics become saturated, but also it brings about a remarkable lowering of electric conductivity.

The reason why the Bi-content is defined to be 0.001 ~ 0.2% is that if the Bi-content is less than 0.001%, it has no effect for improving elongation characteristics, and if it exceeds 0.2%, the degradation of corrosion-resistance is remarkable. The reason why the Sb-content is defined to be 0.01 ~ 0.5% is that if the Sb-content is less than 0.01%, it has no effect for improving elongation characteristics, and if it is in excess of 0.5% not only does the effect for improving elongation characteristics become saturated, but the degradation of electric conductivity is also remarkable.

The reason for defining the heating temperature as 500° ~ 630° C. is as follows: In order to recover the electric conductivity that has been lowered by the Fe-content placed in solid solution at the time of casting, and to improve the elongation property after cold working, it is necessary to carry out heat treatment at some stage to precipitate Fe and also to bring about coarsening of the $Al_3Fe$ compound that has precipitated at the time of casting. A characteristic of the method of the present invention is that this heat treatment is carried out before the step of hot-working. If the heating is done at a temperature lower than 500° C., the coarsening of the precipitates as cast is not sufficient and the precipitates become fine precipitates of about 0.1μ, so that the elongation characteristics after cold drawing will be found to be poor. A temperature of 500° C. or higher is therefore suitable as the heating temperature. If the temperature is in excess of 630° C., on the other hand, it becomes difficult to control temperature, and partial melting must be feared.

Regarding the heat treatment of the wire rod after hot-working, the reason therefor is the same as that mentioned above. However, it is un-necessary if coarsening of the precipitates is not fully completed and the Fe in solid solution is not fully precipitated by heating before the step of hot working. If precipitation of Fe and coarsening the precipitates by heating before hot working is little, it is also possible to precipitate Fe and coarsen the precipitates by heating the wire rod.

As to the duration of heating, it should be defined as being not less than 0.5 hours, if the time required for the coarsening of the precipitates as cast and for precipitating Fe in solid solution to the solubility limit of Fe at that temperature is taken into consideration. On the other hand, if the duration exceeds 48 hours, it will become a big obstacle in industrial production and cannot be employed for practical purposes.

According to the method of the present invention, the treatment for the coarsening of precipitates as cast and the treatment for the precipitation of Fe may be done before hot-working or after hot-working. However, treatment before hot-working is preferable, as the precipitation treatment by heating after hot-working would bring about some degradation of elongation characteristics.

In the present invention, the ingot after heating generally is hot-rolled in continuation at the same temperature range as that for heating the ingot. The hot rolling is done at the same temperature range for the purpose of preventing precipitation during rolling and recurrence of solid solution of Fe.

As to impurities that may be contained in the alloy, elements that are normally contained in aluminum for electrical purposes of a purity of 99.65% or higher are not objectionable at all. For still greater improvement in elongation characteristics, however, it is desirable that Si does not exceed 0.07%. High purity is preferable, as long as it does not involve a large increase in the cost of the aluminum material.

Now, the present invention will be explained in detail with reference to examples of embodiment.

EXAMPLES OF EMBODIMENT I

Alloys of the compositions shown in Table 1 were melted (Al-10% Fe mother alloy and Ca, Bi, Sb as simple substances being used on Aluminum for electrical purposes of a 99.7% purity) and cast by direct chill casting into wire bars having dimensions of 120mm square ×1500mm; heated for 10 hours at 530° C. and 590° C. and then hot-rolled at that heating temperature into wire rods of 9.5mm diameter. This wire rod was cold-drawn into wire of 1mm diameter. The properties of these wires and of wires obtained by working on EC-Al in the same way are given in Table 1.

As is clear from Table 1, the wires made by the present invention have as compared with the example for comparison of conventional products (EC-Al), an elongation of about 4–7% even in a highly worked-on condition, and possesses, in its cold-drawn condition, an elongation which is about equal to that of a semi-hard wire.

TABLE I

| | ALLOY NO. | HEATING TEMP. (° C) | CHEMICAL CONSTITUENTS (ANALYSIS VALUE: %) Fe | Si | Ca | Bi | Sb | TENSILE STRENGTH (kg/mm²) | ELONGATION (%) | ELEC. COND. (%IACS) |
|---|---|---|---|---|---|---|---|---|---|---|
| PRESENT INVENTION | 1 | 530 | 1.2 | 0.05 | — | — | — | 24.8 | 4.9 | 61.5 |
| | 2 | 590 | 1.2 | 0.05 | — | — | — | 25.4 | 5.4 | 60.7 |
| | 3 | 530 | 1.5 | 0.05 | — | — | — | 26.0 | 5.0 | 60.8 |
| | 4 | 590 | 1.5 | 0.05 | — | — | — | 25.9 | 5.9 | 59.8 |
| | 5 | 530 | 1.8 | 0.05 | — | — | — | 23.4 | 5.7 | 60.3 |
| | 6 | 590 | 1.8 | 0.05 | — | — | — | 23.6 | 6.8 | 59.9 |
| | 7 | 530 | 1.2 | 0.05 | 0.36 | — | — | 19.0 | 6.7 | 60.2 |
| | 8 | 530 | 1.5 | 0.05 | 0.009 | — | — | 21.4 | 7.2 | 60.1 |
| | 9 | 530 | 1.8 | 0.05 | 0.04 | — | — | 22.6 | 7.0 | 59.8 |
| | 10 | 530 | 1.4 | 0.05 | — | 0.007 | — | 21.3 | 6.8 | 60.8 |
| | 11 | 530 | 1.6 | 0.05 | — | 0.15 | — | 23.0 | 6.7 | 60.6 |
| | 12 | 530 | 1.9 | 0.05 | — | 0.02 | — | 25.1 | 7.9 | 60.4 |
| | 13 | 530 | 1.0 | 0.05 | — | — | 0.05 | 20.7 | 5.9 | 60.7 |
| | 14 | 530 | 1.3 | 0.05 | — | — | 0.28 | 21.6 | 6.4 | 60.3 |
| | 15 | 530 | 1.7 | 0.05 | — | — | 0.40 | 22.5 | 7.3 | 59.8 |
| | 16 | 530 | 1.9 | 0.05 | — | — | 0.03 | 23.7 | 7.6 | 59.4 |
| EX. FOR COMP. | 17 | 530 | 0.15 | 0.06 | — | — | — | 22.9 | 1.8 | 62.4 |
| | 18 | 590 | 0.15 | 0.06 | — | — | — | 23.5 | 0.9 | 61.9 |

EXAMPLES OF EMBODIMENT 2

Alloys of the compositions shown in Table 2 were melted (Al-10% Fe mother alloy and Ca, Bi, Sb as simple substances being used on Aluminum for electrical purposes of a 99.7% purity) and cast by direct chill casting into wire bars having dimensions of 120mm$^2$ ×1500mm; these were heated at 450° C. for 2 hours and then hot rolled at that heating temperature into wire rods of 9.5mm diameter. These wire rods were heated at 400° C., 530° C. and 590° C. for 8 hours each, and then cold-drawn into wires of 1mm diameter. The properties of these wires were found as shown in Table 2.

It is noted from Table 2 that the wires made according to the present invention have an elongation of 4% or more in their condition after drawing and can be used as the so-called semi-hard wires, while contrarily that of the Example for Comparison has an elongation reduced to 3% or less and cannot be used as semi-hard wire.

TABLE 2

| | ALLOY NO. | COND. FOR HEATING AT 9.5mmϕ | CHEMICAL CONSTITUENTS (ANALYSIS VALUE: %) Fe | Si | Ca | Bi | Sb | TENSILE STRENGTH (kg/mm$^2$) | ELON-GATION (%) | ELEC. COND. (% IACS) |
|---|---|---|---|---|---|---|---|---|---|---|
| PRESENT INVENTION | 19 | 530° C×8h | 1.2 | 0.05 | — | — | — | 19.8 | 4.8 | 61.2 |
| | 20 | 590° C×8h | 1.2 | 0.05 | — | — | — | 21.8 | 4.3 | 61.0 |
| | 21 | 530° C×8h | 1.4 | 0.05 | 0.15 | — | — | 19.5 | 5.0 | 60.8 |
| | 22 | 530° C×8h | 1.8 | 0.05 | 0.09 | — | — | 19.7 | 6.2 | 60.4 |
| | 23 | 530° C×8h | 1.2 | 0.05 | — | 0.10 | — | 20.6 | 5.4 | 60.8 |
| | 24 | 530° C×8h | 1.7 | 0.05 | — | 0.07 | — | 21.1 | 6.2 | 60.4 |
| | 25 | 530° C×8h | 1.2 | 0.05 | — | — | 0.13 | 20.3 | 5.5 | 60.3 |
| | 26 | 530° C×8h | 1.8 | 0.05 | — | — | 0.25 | 21.0 | 6.6 | 60.2 |
| EXAMPLES FOR COMP. | 27 | 400° C×8h | 1.2 | 0.05 | — | — | — | 20.0 | 1.1 | 61.5 |

EXAMPLE OF EMBODIMENT 3

Soft wires were obtained by subjecting wires 1.0mm in diameter of Alloys No. 1, No. 3, No. 5, No. 7, No. 9, No. 10, No. 12, No. 13 and No. 15 of Table 1, Alloys No. 19, No. 20, No. 21, No. 23 and No. 25 of Table 2, and EC-Al to annealing under the conditions shown in Table 3.

Their properties were found to be as shown in Table 3.

TABLE 3

| ANNEALING CONDITIONS | 275° C × 1 HR. | | | 580° C × 2 SEC. | | |
|---|---|---|---|---|---|---|
| ALLOY NO. | TENSILE STRENGTH (kg/mm$^2$) | ELON-GATION (%) | ELECTRIC COND. (%IACS) | TENSILE STRENGTH (kg/mm$^2$) | ELON-GATION (%) | ELECTRIC COND. (%IACS) |
| 1. | 13.1 | 25.0 | 62.5 | 13.4 | 23.2 | 62.3 |
| 3. | 13.6 | 24.1 | 62.5 | 13.8 | 22.9 | 62.2 |
| 5. | 13.3 | 24.6 | 62.3 | 13.4 | 21.8 | 62.0 |
| 7. | 12.8 | 26.0 | 62.1 | 12.8 | 24.3 | 62.0 |
| 9. | 13.6 | 23.7 | 61.9 | 13.7 | 23.5 | 61.8 |
| 10. | 13.2 | 24.5 | 62.6 | 13.5 | 21.4 | 62.5 |
| 12. | 13.7 | 20.6 | 62.4 | 13.9 | 19.5 | 62.2 |
| 13. | 13.0 | 27.0 | 62.4 | 13.1 | 25.6 | 62.4 |
| 15. | 13.5 | 26.1 | 62.2 | 13.4 | 23.7 | 62.1 |
| 19. | 12.8 | 29.4 | 62.7 | 12.7 | 30.1 | 62.7 |
| 20. | 13.1 | 28.5 | 62.7 | 13.2 | 29.1 | 62.6 |
| 21. | 12.7 | 25.4 | 62.0 | 12.9 | 24.7 | 62.0 |
| 23. | 13.3 | 26.7 | 62.2 | 13.5 | 25.0 | 62.1 |
| 25. | 13.5 | 25.3 | 62.4 | 13.6 | 23.2 | 62.3 |
| EC-Al | 9.5 | 25.0 | 62.9 | 9.3 | 28.2 | 63.0 |

It is noted that, as compared with EC-Al, the alloys of the present invention have an excellent tensile strength, even if the electric conductivity shows a slight decrease.

The method of the present invention should not be restricted by the aforementioned examples of embodiment. For example, the following modification of the method is also included in the scope of the present invention.

It is a method wherein by annealing at a comparatively low temperature range of 300° ~ 450° C. in continuation to the annealing at 500° ~ 630° C., before or after the hot-working of the ingot into a wire rod, Fe in solid solution on the $Al_3Fe$ precipitates produced by the coarsening by the former annealing is precipitated for further recovery of electric conductivity.

As has been described in detail with reference to examples of embodiment, the manufacturing method of the present invention provides not only a conductor which, as compared with that of EC-Al, shows almost no reduction in electric conductivity and possesses a remarkably high strength as a soft wire, but also a conductor which has excellent elongation properties of 4% or more even in a highly worked-on condition after cold-working and which has an excellent workability.

What is claimed is:

1. A method of manufacturing an aluminum alloy for electric conductors which is characterized by casting an aluminum-iron type alloy consisting of 1.0 ~ 2.0% iron and the remainder substantially of aluminum into an ingot, heating said ingot at 500° ~ 630° C. for 0.5 ~ 48 hours to effect coarsening of precipitates as cast and precipitation of a portion of Fe in solid solution, and then hot-working said ingot into a wire rod.

2. A method of manufacturing an aluminum alloy for electric conductors as claimed in claim 1, wherein the wire rod after hot-working is subjected to cold-working of 90% or more to draw it into a wire and then annealing that wire at 150° ~ 600° C. for from 0.5 second to 10 hours, thereby imparting a tensile strength of 12 ~ 15 Kg/mm$^2$, elongation of 20% or more and electric conductivity of 61% IACS or more to a soft aluminum alloy wire.

3. A method of manufacturing an aluminum alloy for electric conductors which is characterized by casting an aluminum-iron type alloy consisting of 1.0 ~ 2.0% iron and the remainder substantially of aluminum into an ingot, hot working that ingot into a wire rod, and then heating the rod at 500° ~ 630° C. for 0.5 ~ 48 hours for coarsening of precipitates as cast and precipitation of a portion of Fe in solid solution.

4. A method of manufacturing an aluminum alloy for electric conductors as claimed in claim 3, wherein the wire rod after heating is subjected to cold-working of 90% or more to draw it into a wire and then that wire is annealed at 150° ~ 600° C. for from 0.5 second to 10 hours, thereby imparting a tensile strength of 12 ~ 15 $Kg/mm^2$, elongation of 20% or more and electric conductivity of 61% IACS or more to a soft aluminum alloy wire.

5. A method of manufacturing an aluminum alloy for electric conductors which is characterized by casting an aluminum-iron type alloy consisting of 1.0 ~ 2.0% iron, one kind of element selected from the group consisting of 0.005 ~ 0.5% calcium, 0.001 ~ 0.2% bismuth and 0.01 ~ 0.5% antimony and the remainder substantially of aluminum into an ingot, heating said ingot at 500° ~ 630° C. for 0.5 ~ 48 hours to effect coarsening of precipitates as cast and precipitation of a portion of Fe in solid solution, and then hot-working said ingot into a wire rod.

6. A method of manufacturing an aluminum alloy for electric conductors as claimed in claim 5, wherein the wire rod after hot-working is subjected to cold-working of 90% or more to draw it into a wire and then annealing that wire at 150° ~ 600° C. for from 0.5 second to 10 hours, thereby imparting a tensile strength of 12 ~ 15 $Kg/mm^2$, elongation of 20% or more and electric conductivity of 61% IACS or more to a soft aluminum alloy wire.

7. A method of manufacturing an aluminum alloy for electric conductors which is characterized by casting an aluminum-iron type alloy consisting of 1.0 ~ 2.0% iron, one kind of element selected from the group consisting of 0.005 ~ 0.5% calcium, 0.001 ~ 0.2% bismuth and 0.01 ~ 0.5% antimony and the remainder substantially of aluminum into an ingot, hot-working that ingot into a wire rod, and then heating the rod at 500° ~ 630° C. for 0.5 ~ 48 hours for coarsening of precipitates as cast and precipitation of a portion of Fe in solid solution.

8. A method of manufacturing an aluminum alloy for electric conductors as claimed in claim 7, wherein the wire rod after heating is subjected to cold-working of 90% or more to draw it into a wire and then that wire is annealed at 150° ~ 600° C. for from 0.5 second to 10 hours, thereby imparting a tensile strength of 12 ~ 15 $Kg/mm^2$, elongation of 20% or more and electric conductivity of 61% IACS or more to a soft aluminum alloy wire.

* * * * *

UNITED STATES PATENT OFFICE

CERTIFICATE OF CORRECTION

Patent No. 4,138,275 Dated February 6, 1979

Inventor(s) Minoru Yokota and Kenichi Sato

It is certified that error appears in the above-identified patent and that said Letters Patent are hereby corrected as shown below:

In the ABSTRACT on the Title Page, in the next-to-last line, "500° 14 630°C" should be corrected to read --500° - 630° C--

Signed and Sealed this

*Tenth* Day of *July 1979*

[SEAL]

*Attest:*

*Attesting Officer*

LUTRELLE F. PARKER

*Acting Commissioner of Patents and Trademarks*